US007753769B2

(12) United States Patent
Gomez et al.

(10) Patent No.: US 7,753,769 B2
(45) Date of Patent: Jul. 13, 2010

(54) WAGERING GAME FOR IMPLEMENTING GAME-ENHANCEMENT PARAMETERS WITH A GUARANTEED BONUS

(75) Inventors: Benjamin T. Gomez, Chicago, IL (US); Alfred Thomas, Las Vegas, NV (US)

(73) Assignee: WMS Gaming, Inc., Waukegan, IL (US)

( * ) Notice: Subject to any disclaimer, the term of this patent is extended or adjusted under 35 U.S.C. 154(b) by 561 days.

(21) Appl. No.: 11/358,373

(22) Filed: Feb. 21, 2006

(65) Prior Publication Data

US 2006/0189377 A1 Aug. 24, 2006

Related U.S. Application Data

(60) Provisional application No. 60/655,192, filed on Feb. 22, 2005.

(51) Int. Cl.
*A63F 9/24* (2006.01)

(52) U.S. Cl. ..... 463/16; 463/19; 463/20; 463/22; 463/25

(58) Field of Classification Search ..... 463/16, 463/19, 20, 22, 25
See application file for complete search history.

(56) References Cited

U.S. PATENT DOCUMENTS 5,342,047 A 8/1994 Heidel et al.
5,647,798 A 7/1997 Falciglia
5,848,932 A * 12/1998 Adams ..... 463/20
5,935,002 A 8/1999 Falciglia
5,951,397 A 9/1999 Dickinson
5,971,849 A 10/1999 Falciglia
6,179,711 B1 * 1/2001 Yoseloff ..... 463/25
6,193,608 B1 * 2/2001 Walker et al. ..... 463/25
6,311,976 B1 * 11/2001 Yoseloff et al. ..... 273/138.2
6,605,001 B1 * 8/2003 Tarantino ..... 463/22
6,776,711 B1 * 8/2004 Baerlocher ..... 463/16
6,984,173 B1 * 1/2006 Piechowiak et al. ..... 463/20
7,070,501 B2 7/2006 Cormack et al.
2003/0069063 A1 * 4/2003 Bilyeu et al. ..... 463/20
2004/0266517 A1 12/2004 Bleich et al.

* cited by examiner

*Primary Examiner*—Peter DungBa Vo
*Assistant Examiner*—Omkar Deodhar
(74) *Attorney, Agent, or Firm*—Nixon Peabody LLP

(57) ABSTRACT

A gaming terminal is utilized for playing a wagering game. A wager-input device receives a wager from a player. A display displays symbols indicating a randomly selected outcome selected from a plurality of outcomes. The plurality of outcomes include at least one special-event outcome that awards additional game play at a time selectable by the player. The additional game play provides a guaranteed winning outcome. A special-event input device initiates the additional game play in response to the player activating the special-event input device. The additional game play is implemented with a game-enhancement parameter such that the guaranteed winning outcome has an enhanced payout.

20 Claims, 9 Drawing Sheets

WAGERING GAME FOR IMPLEMENTING GAME-ENHANCEMENT PARAMETERS WITH A GUARANTEED BONUS

CROSS-REFERENCE TO RELATED APPLICATION

This application claims priority to, and hereby incorporates by reference, U.S. Provisional Application No. 60/655,192, entitled "Wagering Game for Implementing Game-Enhancement Parameters with a Guaranteed Bonus," filed Feb. 22, 2005, with the United States Patent and Trademark Office.

FIELD OF THE INVENTION

The present invention relates generally to gaming terminals for playing a wagering game and, more particularly, to a gaming terminal having a feature for providing game-enhancement parameters that can result in higher payouts. The game-enhancement parameter may be used in conjunction with a guaranteed payout feature that provides at least a minimum payout.

BACKGROUND OF THE INVENTION

Gaming terminals, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming terminal industry, there is a continuing need for gaming terminal manufacturers to produce new types of games, or enhancements to existing games, which will attract frequent play by enhancing the entertainment value and excitement associated with the game.

One concept that has been successfully employed to enhance the entertainment value of a game is that of a "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a progressive jackpot. In the gaming industry, a "progressive" involves collecting coin-in data from participating gaming device(s) (e.g., slot machines), contributing a percentage of that coin-in data to a jackpot amount, and awarding that jackpot amount to a player upon the occurrence of a certain jackpot-won event. The percentage of the coin-in is determined prior to any result being achieved and is independent of any result. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming terminal without winning the jackpot. Further, when several gaming terminals are linked together such that several players at several gaming terminals compete for the same jackpot, the jackpot progressively increases at a much faster rate, which leads to further player excitement.

Another way to increase player excitement is by providing a collectable bonus award that can be utilized at a later time for a guaranteed minimum payout. This type of guaranteed bonus can take the form of symbols representing guaranteed wins on reels of a slot machine that are accumulated by the player when they are aligned on a payline. The guaranteed-win awards can then be redeemed at a later time for a guaranteed minimum payout in a subsequent spin. This arrangement provides the player with the additional thrill of feeling in control of the rhythm and emotion of game play, and the guaranteed payouts resulting from the redemption of the guaranteed-win award ensures a positive gaming experience for the player. However, even guaranteed minimum wins can sometimes become monotonous to the player.

Wagering games need to include additional features that will maintain the player's interest and enhance entertainment. The present invention is directed to satisfying this and other needs.

SUMMARY OF THE INVENTION

The present invention is directed to a gaming terminal for playing a wagering game. A wager-input device receives a wager from a player. A display displays symbols indicating a randomly selected outcome selected from a plurality of outcomes. The plurality of outcomes include at least one special-event outcome that awards additional game play at a time selectable by the player, and the additional game play provides a guaranteed winning outcome. A special-event input device initiates the additional game play in response to the player activating the special-event input device. The additional game play is implemented with a game-enhancement parameter such that the guaranteed winning outcome has an enhanced payout.

Another aspect of the invention is directed to a method of conducting a wagering game. A wager is received from a player. A game outcome is randomly selected from a plurality of outcomes in response to the wager. The plurality of outcomes include at least one special-event outcome that awards additional game play at a time selectable by the player, and the additional game play provides a guaranteed winning outcome. The game outcome is displayed on a display. The additional game play is initiated in response to the player activating a special-event input device. The additional game play is implemented with a game-enhancement parameter such that the guaranteed winning outcome has an enhanced payout.

An additional aspect of the invention is directed to a gaming system for playing a wagering game. The gaming system has at least one display and a controller coupled to the display. The controller is programmed to initiate the wagering game in response to detection of a wager from a player. The wagering game displays symbols indicating a randomly selected outcome selected from a plurality of outcomes. The plurality of outcomes include at least one special-event outcome that awards additional game play at a time selectable by the player. The additional game play provides a guaranteed winning outcome. The controller also, in response to a special-event input by the player, initiates the additional game play providing the guaranteed winning outcome. The additional game play is implemented with a game-enhancement parameter such that the guaranteed winning outcome has an enhanced payout The above summary of the present invention is not intended to represent each embodiment or every aspect of the present invention. The detailed description and figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
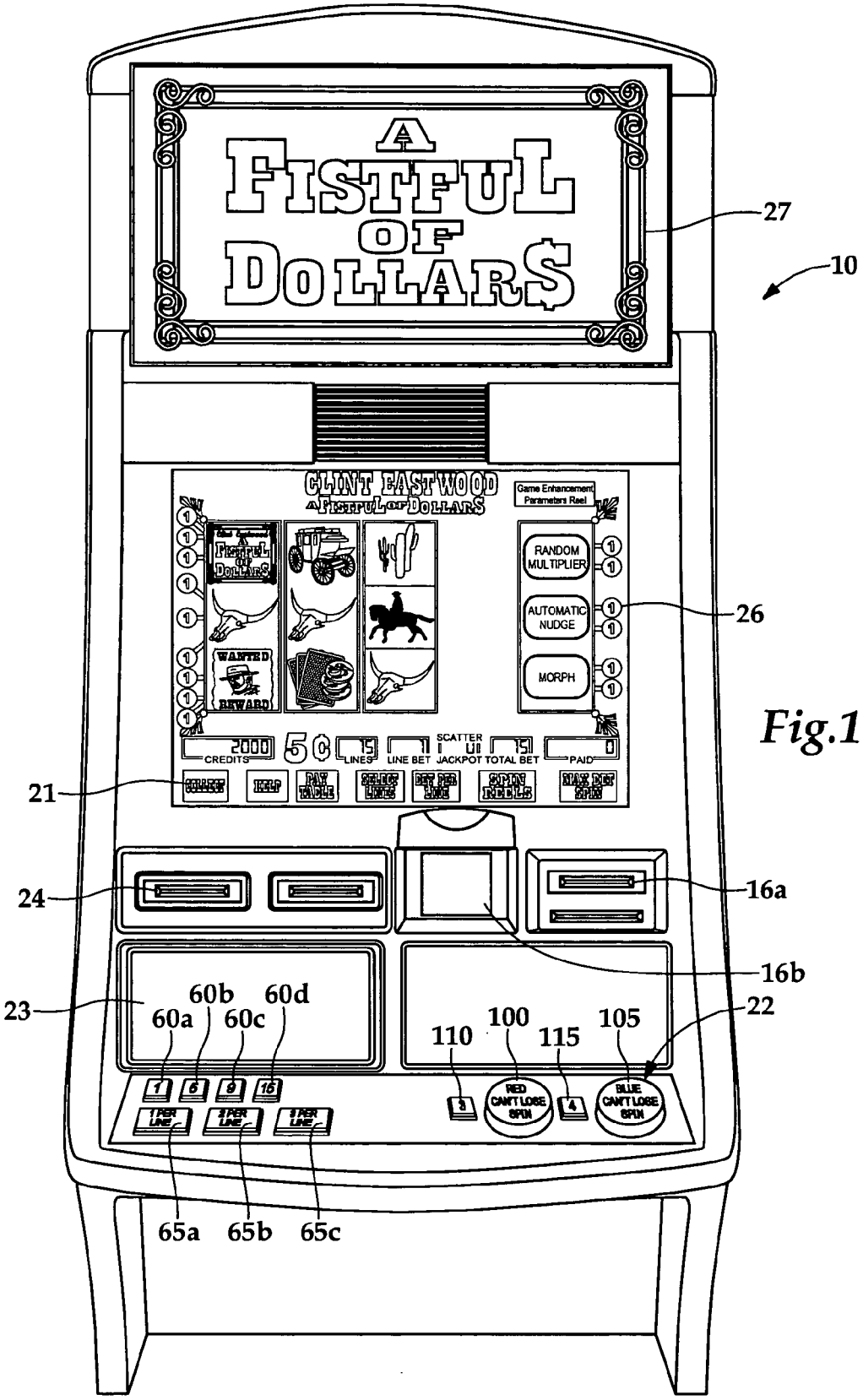
FIG. 1 is a perspective view of a video gaming terminal according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a perspective view of a typical gaming terminal 10 used by gaming establishments, such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play video slots or a video casino game, such as blackjack, slots, keno, poker, etc.

As shown, the gaming terminal 10 includes input devices, such as a wager acceptor 16 (shown as a card wager acceptor 16*a* and a cash wager accepter 16*b*), a touch screen 21, a push-button panel 22, and an information reader 24. For outputs, the gaming terminal 10 includes a payout mechanism 23, a main display 26 for displaying information about the basic wagering game, and a secondary display 27 that may display an electronic version of a pay table, and/or also possibly game-related information or other entertainment features. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The cash wager acceptor 16*a* may include a coin slot acceptor or a note acceptor to input value to the gaming terminal 10. The card wager acceptor 16*b* may include a card-reading device for reading a card that has a recorded monetary value with which it is associated. The card wager acceptor 16*b* may also receive a card that authorizes access to a central account, which can transfer money to the gaming terminal 10.

Also included is the payout mechanism 23, which performs the reverse functions of the wager acceptor. For example, the payout mechanism 23 may include a coin dispenser or a note dispenser to output value from gaming terminal 10. Also, the payout mechanism 23 may also be adapted to receive a card that authorizes the gaming terminal to transfer credits from the gaming terminal 10 to a central account.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The outcome of the basic wagering game is displayed to the player on the main display 26. The main display 26 may take the form of a cathode ray tube (CRT), a high resolution LCD, a plasma display, LED, or any other type of video display suitable for use in the gaming terminal 10. As shown, the main display 26 includes the touch screen 21 overlaying the entire display (or a portion thereof) to allow players to make game-related selections. Alternatively, the gaming terminal 10 may have a number of mechanical reels to display the game outcome, as well.

In some embodiments, the information reader 24 is a card reader that allows for identification of a player by reading a card with information indicating his or her true identity. Currently, identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10. The information reader 24 may also include a keypad (not shown) for entering a personal identification number (PIN). The gaming terminal 10 may require that the player enter their PIN prior to obtaining information. The gaming terminal 10 may use the secondary display 27 for providing the player with information about his or her account or other player-specific information. Also, in some embodiments, the information reader 24 may be used to restore assets that the player achieved during a previous game session and had saved.

A player begins play of the basic wagering game by inserting a wager input into the wager input accepter 16*a*, 16*b* of the gaming terminal 10. A player can select play by either using the touch screen 21 or the push-button panel 22. The basic game consists of a plurality of reels having symbols that are displayed along a plurality of paylines, yielding a plurality of outcomes of the basic game. Such outcomes are randomly selected and then displayed in response to the wagering input by the player.

Figure 2:
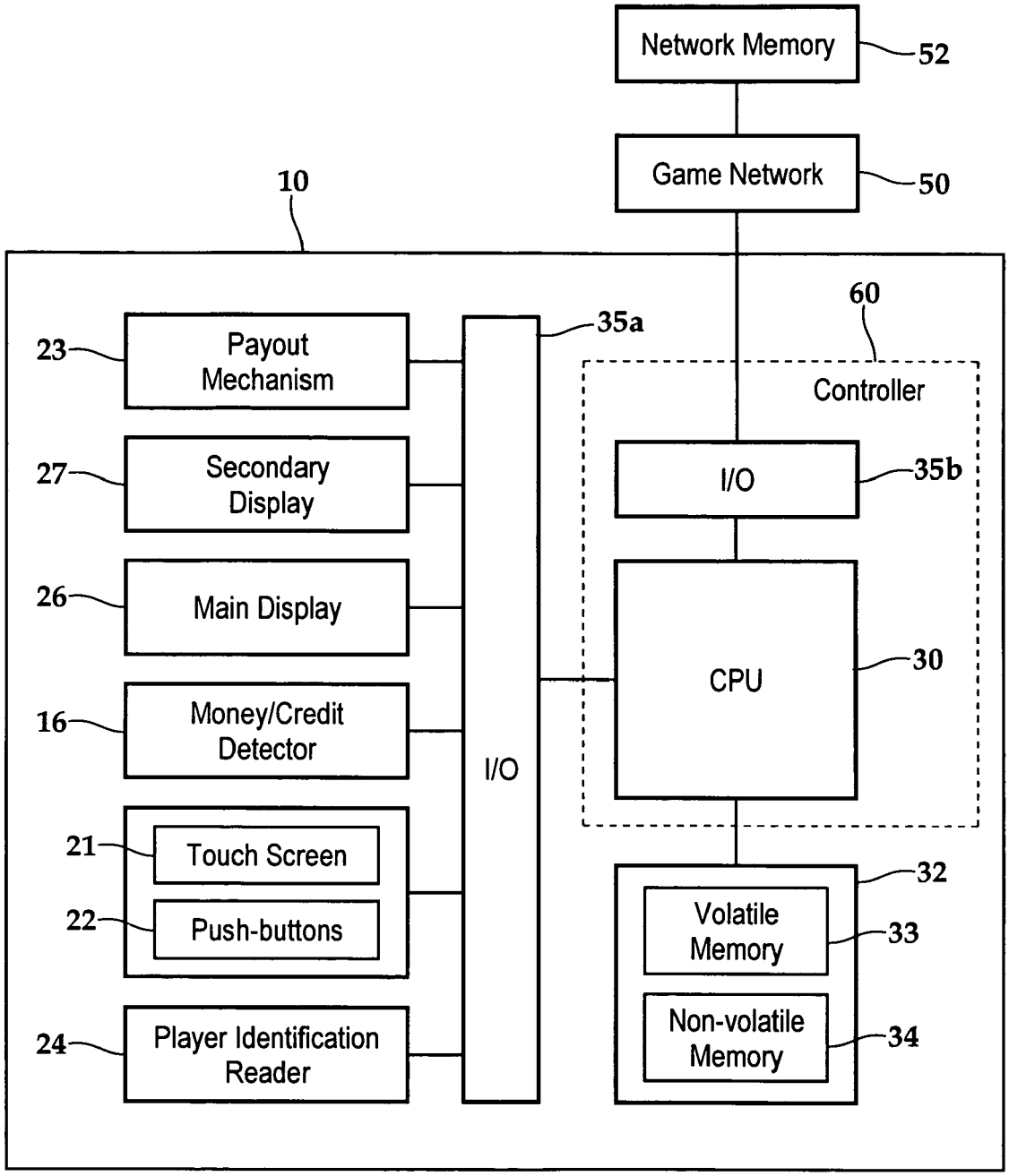
FIG. 2 is a block diagram of the gaming terminal of FIG. 1.

As shown in FIG. 2, the various components of the gaming terminal 10 are controlled by a central processing unit (CPU) 30 (such as a microprocessor or microcontroller). To provide the gaming functions, the CPU 30 executes a game program that allows for the randomly selected outcome. The CPU 30 is also coupled to or includes a local memory 32. The local memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the local memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

In some embodiments, the CPU 30 may not be inside the gaming terminal 10. Instead, the CPU 30 may be part of a game network 50 (FIG. 2) and may be used to control numerous gaming terminals 10. In these embodiments, the CPU 30 will run the basic games for each of the gaming terminals 10, and may also be used to link the gaming terminals 10 together. The game network 50 can include progressive jackpots that are contributed to by all or some of the gaming terminals 10 in the network (e.g., terminal-level jackpots that only each terminal 10 contributes to, bank-level jackpots that are contributed to by all of the terminals 10 in a particular bank, and wide-area jackpots that are contributed to by a larger number of terminals 10, such as multiple banks). Alternatively, the game network 50 can allow the player to retrieve assets obtained while playing one terminal 10 at a different gaming terminal that is also part of the game network. Assets may be any number of things, including, but not limited to, monetary or non-monetary awards, features that a player builds up in a bonus or progressive game to win awards, etc.

In some embodiments, the CPU 30 is also used with the information reader 24 to restore saved assets. For example, in one embodiment, the information reader 24 is adapted to receive and distribute tickets. The tickets each include a unique identifier. The unique identifier links the ticket to a file contained within the local memory 32 or a system memory 52 located in the game network 50. The file includes the assets that are being stored from a previous game. Monetary awards include game credits or money, while the non-monetary awards can be bonus tokens, free plays (e.g., free spins), multipliers, or access to bonus and/or progressive games. The player may also be awarded the option of selecting between receiving a certain value of standard credits or receiving bonus tokens that are redeemable for a special wagering event. The player may also be awarded various game-enhancement parameters (e.g., a multiplier for increasing a payout) that may be accumulated for later use.

The gaming terminal 10 and associated gaming control system is capable of executing wagering games on or through a controller 60. Controller 60, as used herein, comprises any combination of hardware, software, and/or firmware that may be disposed or resident inside and/or outside of the gaming terminal 10 or a similar machine which may communicate with and/or control the transfer of data between the gaming terminal and a bus, another computer, processor, or device, and/or a service and/or a network. The network may include, but is not limited to a peer-to-peer, client/server, master/slave, star network, ring network, bus network, or other network architecture wherein at least one processing device (e.g., computer) is linked to at least one other processing device. The controller 60 may comprise the I/O circuits 35*b* and the CPU 30. In other embodiments, the CPU 30 may be housed outside of the controller 60, and a different processor may be housed within the controller 60. The controller 60, as used herein, may comprise one or more controllers. In one implementation, each gaming terminal 10 comprises, or is connected to, a controller 60 enabling each gaming terminal 10 to transmit and/or receive signals, preferably both, in a peer-to-peer arrangement. In another example, the controller 60 may be adapted to facilitate communication and/or data transfer for one or more gaming terminals 10 in a client/server or centralized arrangement. In one aspect, shown in FIG. 2, the controller 60 may connect the gaming terminal 10 via a conventional I/O port and communication path (e.g., serial, parallel, IR, RC, 10 bT, etc.) to the game network 50, which may include, for example, other gaming terminals connected together in the network 50.

Embodiments of the present invention utilize various game-enhancement parameters to provide a player with additional excitement during play. Different types of game-enhancement parameters provide the player with the opportunity to achieve a higher payout or make it easier for the player to achieve a payout or other award. The game-enhancement parameters discussed below may be specific to the particular gaming terminal 10 used by the player or they may be randomly assigned to the player. The various game-enhancement parameters include: "RANDOM MULTIPLIER," "AUTOMATIC NUDGE," "UPGRADE," "DIFFERENT PAY TABLE," "EXTRA WILD," "SCATTER," "RIGHT-TO-LEFT," "RE-SPIN," "MORPH," "INCREASED WAGER," "HOLD SYMBOL," and "SYMBOL MOVEMENT."

These game-enhancement parameters are utilized in different embodiments which are described below. The first embodiment implements a "guaranteed win" feature along with a game-enhancement parameter. The second embodiment allows the player to accumulate various game-enhancement parameters and redeem/implement the accumulated game-enhancement parameters at a time of the player's choosing. The third embodiment allows the player to accumulate free spins, each of which is associated with a particular game-enhancement parameter and can be redeemed/utilized at a time of the player's choosing.

A. Game Enhancement-Parameters

RANDOM MULTIPLIER: The RANDOM MULTIPLIER game-enhancement parameter multiplies a payout or other outcome awarded to the player. The RANDOM MULTIPLIER game-enhancement parameter may take the form of an electronic pair of dice or a single die spinning on the display 26. While the die/dice spins, an internal light on the gaming terminal 10 flashes to indicate potential multipliers available to the player (e.g., 1×-6×). Once the die/dice stops spinning, the player is awarded a multiplier equal to the number displayed on the die/dice. In other embodiments, the player is awarded, e.g., a 1× multiplier when the die/dice stops on an odd number, and a 2× multiplier when the die/dice stops on an even number. Once the reels stop spinning, the winning result is multiplied by the multiplier. In other embodiments, the value of the RANDOM MULTIPLIER game-enhancement parameter may be determined by any other pseudo-random process.

AUTOMATIC NUDGE: The AUTOMATIC NUDGE game-enhancement parameter is advantageous in situations where a better payout can be achieved by moving symbols on one (or multiple) reels either up or down across a payline. This game-enhancement parameter automatically "nudges" the reels to the better symbol combination to achieve a higher payout. For example, in the event that three reels display a combination of "3-bars," "3-bars," and "1-bar" symbols on an active payline, and a "3-bars" symbol is located directly above the "1-bar" symbol on the third reel, the symbols on the third reel would be nudged downward so that three "3-bars" symbols are displayed on the payline, resulting in a higher payout.

UPGRADE: The UPGRADE game-enhancement parameter causes a winning symbol combination to move up at least one or two winning symbol combinations on the pay table for the gaming terminal 10. For example, a lower-paying combination of three "cherry" symbols may pay out as if the player had achieved three "3-bars" symbols, a better combination.

DIFFERENT PAY TABLE: The DIFFERENT PAY TABLE game-enhancement parameter implements a different and higher-paying pay table, awarding larger payouts for various symbol combinations. For example, if a combination of three "cherry" symbols normally pays out 2 credits for each credit wagered, the DIFFERENT PAY TABLE game-enhancement parameter may result in a payout of 3 credits for each credit wagered for the combination.

EXTRA WILD: The EXTRA WILD game-enhancement parameter causes a symbol that is normally a regular symbol, such as a "cherry" symbol or a "1-bar" symbol, to become a wild symbol. For example, in the event that (a) the player achieves a combination of consecutive "3-bars," "3-bars," and "1-bar" symbols, and (b) and the EXTRA WILD game-enhancement parameter causes all "1-bar" symbols to become wild symbols, then (c) the wild "1-bar" symbol would represent a "3-bars" symbol, and the player would be awarded a payout for achieving a combination of three "3-bars" symbols. This combination would provide a larger payout than the initial combination.

SCATTER: The SCATTER game-enhancement parameter converts a single-line pay into a scatter payout, such that a winning combination of symbols need not be located all on a single active payline. As such, the best possible symbol combination on the display results in the award to the player.

RIGHT-TO-LEFT: Many slot games require that winning combinations be comprised of symbols on consecutive reels, and must start with the left-most reel (i.e., these slot games require a "left-to-right" combination of symbols). The RIGHT-TO-LEFT game-enhancement parameter allows "right-to-left" combinations (i.e., combinations starting on the right-most reel and extending left across the reels) to win, in addition to the standard winning "left-to-right" combinations. This game-enhancement parameter is particularly applicable to a slot game having five (or more) reels. For example, if the five symbols on the payline from the left-most reel are "cherry," "1-bar," "1-bar," "1-bar," and "1-bar," the player would not have achieved a winning combination of a machine paying left-to-right only. However, if the RIGHT-TO-LEFT game-enhancement parameter were implemented, then the player would have a winning combination of symbols (i.e., the four "1-bar" symbols from the right side).

This game-enhancement parameter can also enhance the player's payout in additional ways. For example, if the player had achieved three consecutive "cherry" symbols from the left side on a first active payline, and the same four consecutive "1-bar" symbols as discussed above from the right side on a second active payline, the RIGHT-TO-LEFT game-enhancement parameter would result in the player being awarded payouts for winning combinations on both the first and the second active paylines.

In another example, the player may also achieve two winning payouts on the same active payline. For example, if the player had achieved a combination of five consecutive "cherry" symbols on the five reels, the player would be awarded a payout based on both the right-to-left and the left-to-right winning combinations. Also, in the event that only two consecutive symbols are required for a winning combination, the player could achieve two different winning symbol combinations on the same active payline. For example, if the player had achieved "cherry," "cherry," "3-bars," "1-bar," and "1-bar" symbols on the reels, the player would receive a payout for both (a) the left-to-right winning combination of "cherry" symbols, and (b) the right-to-left winning combination of "1-bar" symbols.

RE-SPIN: In the event that the player does not achieve a high-paying winning combination, the RE-SPIN game-enhancement parameter re-spins one or more of the reels, giving the player an additional chance to get a high-paying winning combination. For example, if the player achieves a winning combination of three "cherry" symbols, then the player would be awarded for the win and then the reels would be re-spun, giving the player a chance at an additional payout. In other embodiments, the player has to give up the payout from an initial winning combination in order to implement the RE-SPIN game-enhancement parameter.

MORPH: The MORPH game-enhancement parameter allows one or more symbols on the reels to morph into other symbols that are more beneficial. For example, if the player gets a combination of two "cherry" symbols and a "1-bar" symbol, and (a) the two "cherry" symbols combination provides a certain winning payout, and (b) a combination of three "cherry" symbols would result in a higher winning payout, then the "1-bar" symbol morphs into a "cherry" symbol, resulting in the higher-paying winning combination.

INCREASED WAGER: A winning combination typically results in a payout that is generally proportionate to the amount wagered. For example, when five credits are wagered and the player achieves a winning combination, the payout is at least five times as large as it would have been if only one credit had been wagered. The INCREASED WAGER game-enhancement parameter treats a winning combination as though the player had bet the maximum amount, thereby effectively increasing the wagered amount, resulting in a higher payout. For example, of the player had only wagered 1 of 5 possible credits, the INCREASED WAGER game-enhancement parameter would treat the player's wager as though 5 credits had been wagered.

HOLD SYMBOL: The HOLD SYMBOL game-enhancement parameter holds a symbol in a certain location on one of the reels so that a final symbol combination across the reels must take into account the held symbol. For example, in the event that a "1-bar" symbol is one of the more valuable symbols available, a reel displaying this symbol may be held (e.g., not spun) while the remainder of the reels spin. The symbol on the reel that is held may be selected by the player from a list of different hidden symbols, or may be randomly assigned to the player. Accordingly, when the other reels are spun, the player has a greater chance of receiving a high payout (e.g., by a winning combination including the valuable held symbol).

SYMBOL MOVEMENT: The SYMBOL MOVEMENT game-enhancement parameter allows symbols to move to other locations along a payline if it would result in a better outcome (e.g., a higher payout). For example, symbols can move up or down on the same reel, or they can move across reels if such movement results in a better combination for the player.

The game-enhancement parameters discussed above may be specific to the particular gaming terminal 10 used by the player or they may be randomly assigned to the player. The game-enhancement parameters discussed above are merely examples, and it should be appreciated that this list is not exhaustive. In practice, additional types of game-enhancement parameters may be employed.

First Embodiment

"Can't Lose Spin" Embodiment

The first embodiment of the invention relates to game-enhancement parameters which are used with a guaranteed-win feature. A type of guaranteed win is known as a "Can't Lose Spin" bonus. "Can't Lose Spin" bonuses are awarded periodically to the player based on an outcome of the wagering game—e.g., by a "Can't Lose Spin" bonus symbol appearing in a symbol combination on an active payline of a slot game. The "Can't Lose Spin" bonuses can be accumulated and redeemed at a later time by the player, guaranteeing the player of at least a minimal payout on a spin of the reels of the slot game, thereby enhancing the player's gaming experience. Different types of "Can't Lose Spin" bonuses may be accumulated during game play. For example, red "Can't Lose Spin" bonuses and blue "Can't Lose Spin" bonuses may be available, each of which is associated with a particular game-enhancement parameter discussed above, such that when an accumulated "Can't Lose Spin" bonus is redeemed, the associated game-enhancement parameter is implemented. Of the game-enhancement parameters discussed above, at least the following may be implemented in the first embodiment of the invention with the guaranteed win feature: "RANDOM MULTIPLIER," "AUTOMATIC NUDGE," "UPGRADE," "DIFFERENT PAY TABLE," "EXTRA WILD," "RIGHT-TO-LEFT," "RE-SPIN," "MORPH," "HOLD SYMBOL," and "SYMBOL MOVEMENT."

Figure 3:
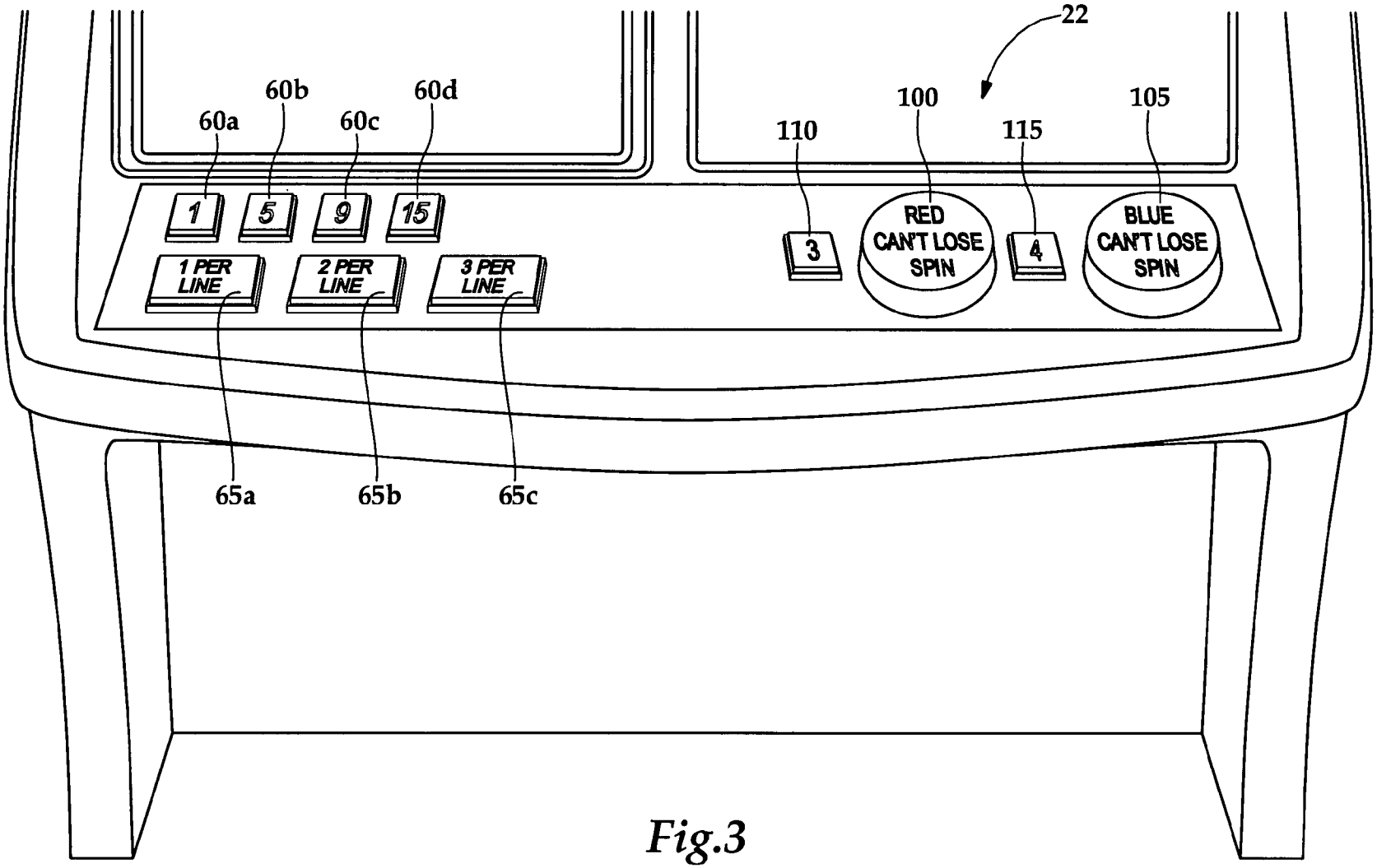
FIG. 3 illustrates the push button panel of the gaming terminal including a plurality of different buttons that serve different purposes according to an embodiment of the invention.

Referring now to FIG. 3, the push button panel 22 of the gaming terminal 10 includes a plurality of different buttons that serve different purposes. A plurality of payline buttons 60*a*, 60*b*, 60*c*, and 60*d* indicates the number of paylines that the player desires to play during the wagering game. There may be, e.g., fifteen paylines that the player may select during the wagering game, or any other suitable number of paylines. The gaming terminal 10 also includes maximum payline buttons 65 (i.e., 65*a-c*) to allow a player to place one, two, or three credit wagers on each of the fifteen paylines 72. While the present embodiment shows four payline buttons 60 and three maximum payline buttons 65, the present invention is useful on gaming terminals 10 having more or less of these payline buttons 60 and 65.

The push-button panel 22 also includes special function buttons. Specifically, red and blue "Can't Lose Spin" bonuses may be accumulated throughout play by, e.g., a red or blue "Can't Lose Spin" bonus symbol landing on an active payline at the end of a spin. Alternatively, one of these bonus symbols could be located anywhere on the visible reels at the end of the spin for the bonus to be awarded to the player. The player can accumulate the red "Can't Lose Spin" bonuses or the blue "Can't Lose Spin" bonuses for a later redemption, as described below.

The player can select either a red "Can't Lose Spin" bonus button 100 or a blue "Can't Lose Spin" bonus button 105, which activate the red and blue "Can't Lose Spin" bonuses, respectively. A red meter 110 is associated with the red "Can't Lose Spin" bonus and indicates how many red "Can't Lose Spin" bonuses have been accumulated. The player may choose to redeem all of the red "Can't Lose Spin" bonuses at once or may choose to redeem one at a time, or any combination thereof. In some embodiments, the player may also redeem multiple red "Can't Lose Spin" bonuses at a time by depressing the red "Can't Lose Spin" bonus button 100 multiple times—an eventual winning outcome may then be multiplied by a number of red "Can't Lose Spin" bonuses that were redeemed.

Likewise, a blue meter 115 is associated with the blue "Can't Lose Spin" bonus and indicates the number of blue "Can't Lose Spin" bonuses that have been accumulated. Each of the meters 110 and 115 may have an LED that indicates the number of "Can't Lose Spin" bonuses that have been accumulated, or buttons 100 and 105 can have LEDs within them, eliminating a need for separate meters 110 and 115.

The red "Can't Lose Spin" bonus may provide larger payouts and may therefore be more difficult to accumulate than the blue "Can't Lose Spin" bonus, or vice-versa. In additional embodiments, instead of having multiple types of "Can't Lose Spin" bonuses, only a single type of "Can't Lose Spin" bonus is utilized. Also, in some embodiments, the red "Can't Lose Spin" bonuses are associated with different game-enhancement parameters than the blue "Can't Lose Spin" bonuses.

An aspect of this embodiment of the invention is that when a "Can't Lose Spin" bonus is redeemed, a game-enhancement parameter is implemented along with the guaranteed-win feature. For example, after the red "Can't Lose Spin" button is depressed, the reels begin spinning and the game-enhancement parameter/feature is automatically implemented. The incorporation of a game-enhancement parameter allows the player to increase the likelihood of higher payouts during redemption of the "Can't Lose Spin" bonus. For example, if the "Can't Lose Spin" bonus implements the RANDOM MULTIPLIER game-enhancement parameter, the player's already guaranteed winning combination will be multiplied by a multiple determined by the RANDOM MULTIPLIER.

As discussed above, different types of "Can't Lose Spin" bonuses may be available. The player can accumulate one basic type of "Can't Lose Spin" bonus and decide when to use it, and the gaming terminal 10 may randomly select whether it will pay out as though it were a red "Can't Lose Spin" bonus or a blue "Can't Lose Spin" bonus. This may be indicated, e.g., through the use of a button that has a blue light and a red light within the gaming terminal's 10 bezel, and the red or blue light is activated when the player elects to use the "Can't Lose Spin" bonus.

In a related embodiment, the player may accumulate a 1× multiplier type of "Can't Lose Spin" bonus and a 2× type of "Can't Lose Spin" bonus during the basic game. The gaming terminal 10 would have two "Can't Lose Spin" bonus buttons—one for the 1× type and the other for the 2× type—and each button would have a meter that indicates how many 1× "Can't Lose Spin" bonuses the player has accumulated and how many 2× "Can't Lose Spin" bonuses the player has accumulated. Also, as a variation, the 2× type of "Can't Lose Spin" bonus may only be available if the player has wagered the maximum amount during the basic game. The 2× (or higher) type multiplier may be know as a "mega-multiplier" because it multiplies the outcome of the "Can't Lose Spin" bonus, potentially resulting in a huge payout.

The "Can't Lose Spin" bonus may be implemented via a persistent state concept. Specifically, the gaming terminal 10 may be connected into a network that allows a player to accumulate the "Can't Lose Spin" bonus from one gaming terminal 10. Then, at a subsequent gaming session, the player can use his or her previously acquired "Can't Lose Spin" bonus at a different gaming terminal. Alternatively, the "Can't Lose Spin" bonus can be in the form of a physical token that can be used on different gaming terminals.

If the RANDOM MULTIPLIER game-enhancement parameter is implemented when a "Can't Lose Spin" bonus is redeemed, the player's guaranteed winning outcome will be multiplied by the value of the RANDOM MULTIPLIER. For example, if the player redeems a "Can't Lose Spin" bonus that provides a winning combination that would normally pay 2 credits, and the RANDOM MULTIPLIER game-enhancement parameter has a value of 3, then the player would be awarded a total of 6 credits (i.e., the guaranteed winning outcome times the value of the RANDOM MULTIPLIER game-enhancement parameter).

In the event that the AUTOMATIC NUDGE game-enhancement parameter is implemented when a "Can't Lose Spin" bonus is redeemed, if a better payout can be achieved by moving symbols on one (or multiple) reels either up or down across a payline, then the reel is automatically "nudged" to the better symbol combination to achieve the better payout. For example, if the gaming terminal has three reels, and the symbols on the active payline are "3-bars," "3-bars," and "cherry," which is a winning symbol combination (i.e., the two "3-bars" symbols), the third reel will be nudged to a "3-bars" symbol in the event that the "3-bars" symbol is located slightly above or slightly below the "cherry" symbol on the third reel. Accordingly, the third reel would be "nudged" to the "3-bars" symbol, providing the player with a combination of three "3-bars" symbols, which provides a better payout.

When a "Can't Lose Spin" bonus is redeemed that is associated with the UPGRADE game-enhancement parameter, the guaranteed-winning symbol combination moves up one or two winning symbol combinations on the pay table for the gaming terminal 10. For example, a lower-paying combination of three "cherry" symbols may pay out as if the player had achieved three "3-bars" symbols, a combination providing a larger payout.

Similarly, when a "Can't Lose Spin" bonus is redeemed that is associated with the DIFFERENT PAY TABLE game-enhancement parameter, a different and higher-paying pay table is implemented to award larger payouts for various symbol combinations. For example, if a combination of three "cherry" symbols normally pays out 2 credits for each credit originally wagered, the DIFFERENT PAY TABLE game-enhancement parameter may cause 3 credits for each credit originally wagered to be paid out for the combination when this game-enhancement parameter is implemented. Accordingly, this game-enhancement parameter effectively increases the value of the guaranteed payout.

When a "Can't Lose Spin" bonus is redeemed that is associated with the EXTRA WILD game-enhancement parameter, a symbol that is normally a regular symbol, such as a "cherry" symbol or a "1-bar" symbol, becomes a wild symbol. For example, in the event that (a) the player achieves a winning combination of consecutive "3-bars," "3-bars," and "1-bar" symbols, and (b) and the EXTRA WILD game-enhancement parameter causes all "1-bar" symbols to become wild symbols, then the wild "1-bar" symbol would represent a "3-bars" symbol, and the player would be awarded a payout for achieving a combination of three "3-bars" symbols. This combination would provide a larger payout than the initial combination.

When a "Can't Lose Spin" bonus is redeemed that is associated with the RIGHT-TO-LEFT game-enhancement parameter, both "right-to-left" combinations and "left-to-right" combinations provide winning outcomes. For example, if a "Can't Lose Spin" bonus is redeemed, the player may achieve two winning payouts on the same active payline. If the player had achieved a combination of five consecutive "cherry" symbols on the five reels, the player would be awarded a payout based on both the right-to-left and the left-to-right winning combinations. Also, in the event that only two consecutive symbols are required for a winning combination, the player could achieve two different winning symbol combinations on the same active payline. For example, if the player had achieved "cherry," "cherry," "3-bars," "1-bar," and "1-bar" symbols on the reels, the player would receive a payout for both (a) the left-to-right winning combination of "cherry" symbols, and (b) the right-to-left winning combination of "1-bar" symbols.

Figure 4:
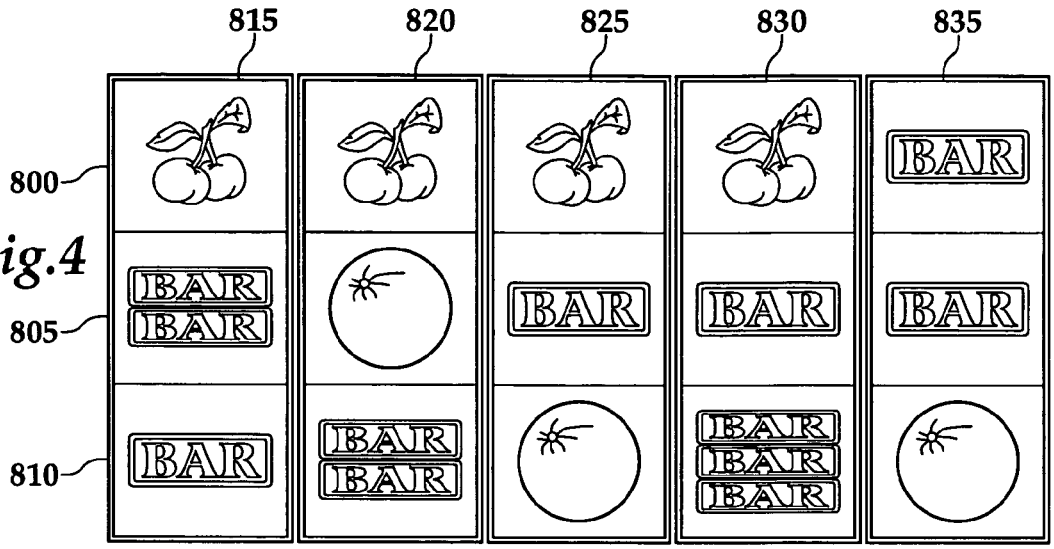
FIG. 4 illustrates a display screen having three active paylines prior to implementation of game-enhancement parameter according to an embodiment of the invention.

Another way to increase the payout is if the player achieves a standard "left-to-right" winning combination on a first active payline in additional to a "right-to-left" winning combination on a different active payline. FIG. 4 illustrates an example where three active horizontal paylines 800, 805, and 810 are utilized. In this example, each active payline covers the symbols on the same vertical position across the five reels 815, 820, 825, 830, and 835. As shown, the first active payline 800 displays a standard winning combination of four "cherry" symbols from the left-hand side. However, in the event that the RIGHT-TO-LEFT game-enhancement parameter had been implemented, the player would also have received a winning combination on the second active payline 805 (i.e., the three "1-bar" symbols from the right-hand side). Accordingly, the player's payout would therefore be increased over the standard payout for the winning "left-to-right" combination on the first active payline 800.

A "Can't Lose Spin" bonus associated with the RE-SPIN game-enhancement parameter that is redeemed re-spins one or more of the reels after the player's initial guaranteed winning combination has been displayed. The player may receive the guaranteed winning combination, and then the one or more of the reels may be re-spun to give the player a chance to earn an additional payout. For example, if the player achieves a winning combination of three "cherry" symbols, then the player would be awarded for the win and then the reels would be re-spun, giving the player a chance at an additional payout without forfeiting the payout for the initial guaranteed winning outcome.

Alternatively, the player may be presented with the option of exchanging the payout from the initial guaranteed winning outcome for the opportunity to re-spin one or more of the reels, with the caveat, however, that the re-spun reels may not provide a guaranteed winning outcome after the reels have been re-spun. Therefore, the player may end up exchanging the guaranteed winning outcome for a non-winning combination.

A "Can't Lose Spin" bonus that is associated with the MORPH game-enhancement parameter allows one or more symbols on the reels to morph into other symbols that are more beneficial. For example, if the player gets a combination of two "cherry" symbols and a "1-bar" symbol, and the two "cherry" symbols has a certain winning outcome, and a combination of three "cherry" symbols would result in a higher winning combination, then the "1-bar" symbol can morph into a "cherry" symbol, resulting in the higher-paying winning combination.

The HOLD SYMBOL game-enhancement parameter holds a symbol in a certain location on one of the reels so that a final symbol combination across the reels must take into account the held symbol. For example, in the event that a "1-bar" symbol is one of the more valuable symbols available, a reel displaying this symbol may be held (e.g., not spun) while the remainder of the reels spin. The symbol on the reel that is held may be selected by the player from a list of different hidden symbols, or may be randomly assigned to the player. Accordingly, when the other reels are spun, the player has a greater chance of receiving a high payout (e.g., by the guaranteed winning combination including the valuable held symbol).

Figure 5A:
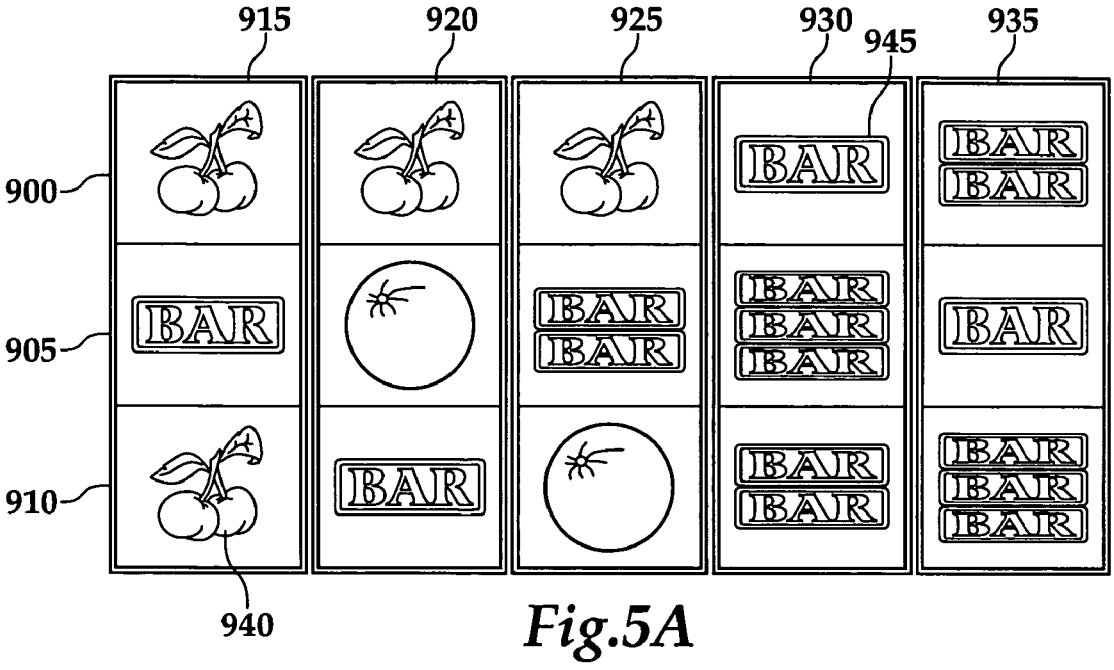
FIGS. 5A and 5B illustrate the display screen of "Can't Lose Spin" bonus spin before and after a "SYMBOL MOVEMENT" game-enhancement parameter is implemented according to an embodiment of the invention.
Figure 5B:
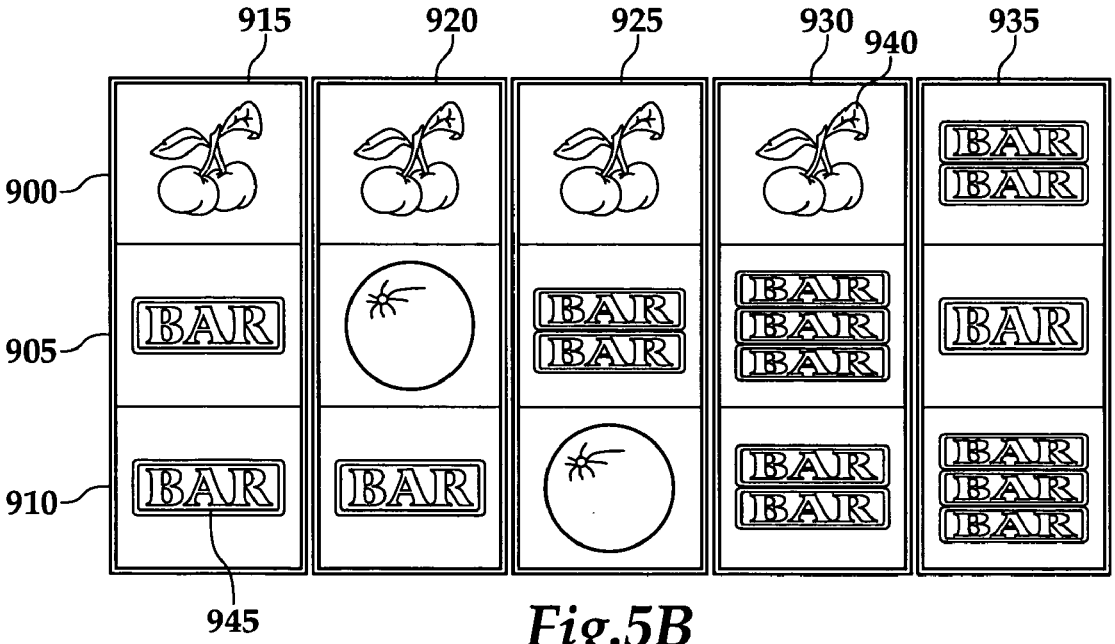

A "Can't Lose Spin" bonus that is associated with the SYMBOL MOVEMENT game-enhancement parameter allows symbols to move to other locations along a payline if it would result in a better outcome (e.g., a higher payout). For example, symbols can move up or down on the same reel, or they can move across reels if such movement results in a better combination for the player. FIG. 5A shows the results after a "Can't Lose Spin" bonus. In this example, there are three active paylines, 900, 905, and 910. The paylines all cover the symbols that are horizontally adjacent across the five reels 915, 920, 925, 930, and 935. Additional paylines are also available, but for the purposes of this illustrative example, only three are shown. As illustrated, the first payline 900 has a combination of three "cherry" symbols, representing a winning outcome. However, if the SYMBOL MOVEMENT game-enhancement parameter is implemented, the "cherry" symbol 940 may switch places with the "2-bars" symbol 945 on the fourth reel 930. The player would then be awarded for achieving a combination of four "cherry" symbols on the first payline 900, as shown in FIG. 5B.

The game-enhancement parameter for a particular "Can't Lose Spin" bonus may be specific to the particular gaming terminal 10 used by the player or it may be randomly assigned to the player when a "Can't Lose Spin" bonus is redeemed. The game-enhancement parameter may be selected based on a spin of an additional reel in the slot game, such as the game-enhancement parameters reel described below with respect to FIG. 6. For example, if the basic slot game has three reels, the "Can't Lose Spin" bonus may utilize a fourth reel on which various potential game-enhancement parameters are represented. Similarly, in embodiments having five reels in the basic slot game, the "Can't Lose Spin" bonus game may utilize a sixth reel having the various game-enhancement parameters. Once the reels stop spinning, the game-enhancement parameter on the payline may be applied to the combination shown on the other reels. Such an embodiment is described below with respect to FIGS. 6-8.

Figure 6:
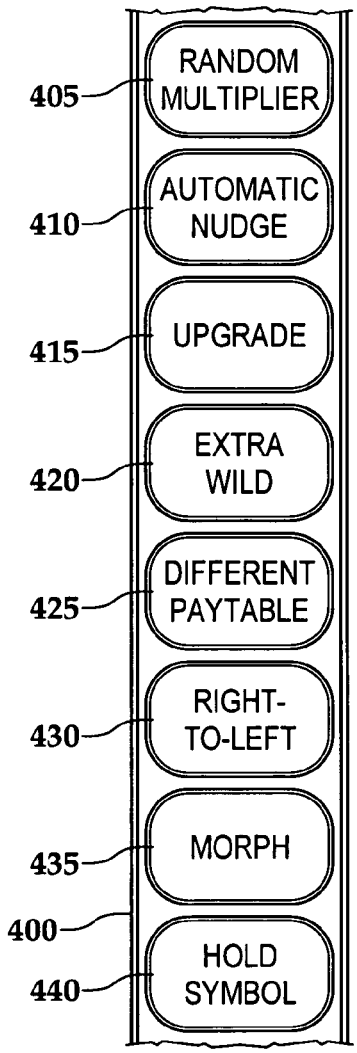
FIG. 6 illustrates a game-enhancement parameters reel in which a "Can't Lose Spin" bonus is randomly assigned a certain type of game-enhancement parameter according to an embodiment of the invention.

FIG. 6 illustrates a game-enhancement parameters reel 400 according to an embodiment of the invention in which each "Can't Lose Spin" bonus is randomly assigned a certain type of game-enhancement parameter. Although many symbols are shown on this unwound illustration of the game-enhancement parameters reel 400, in practice this reel may be the same size as the other reels, and display the same number of symbols at a time to the player (e.g., three viewable symbols). The various game-enhancement parameter symbols include: "RANDOM MULTIPLIER" 405, "AUTOMATIC NUDGE" 410, "UPGRADE" 415, "EXTRA WILD" 420, "DIFFERENT PAY TABLE" 425, "RIGHT-TO-LEFT" 430, "MORPH" 435, and "HOLD SYMBOL" 440. In practice, additional game-enhancement parameters (and a different ordering of the game parameter symbols) may be contained on the game-enhancement parameters reel 400. A limited number are shown just as an example.

After the player has accumulated at least one "Can't Lose Spin" bonus, the game-enhancement parameters reel 400 is utilized when the player decides to use one of the accumulated "Can't Lose Spin" bonuses. More specifically, the player may depress a button similar to one of the buttons 100 or 105 described above with respect to FIG. 3 to "cash in" or redeem one of the "Can't Lose Spin" bonuses. The game-enhancement parameters reel 400 is then activated and the corresponding game-enhancement parameter is awarded to the player for that specific "Can't Lose Spin" bonus. Alternatively, the corresponding game-enhancement parameter is awarded to the player after the reels have shown a winning outcome.

Figure 7:
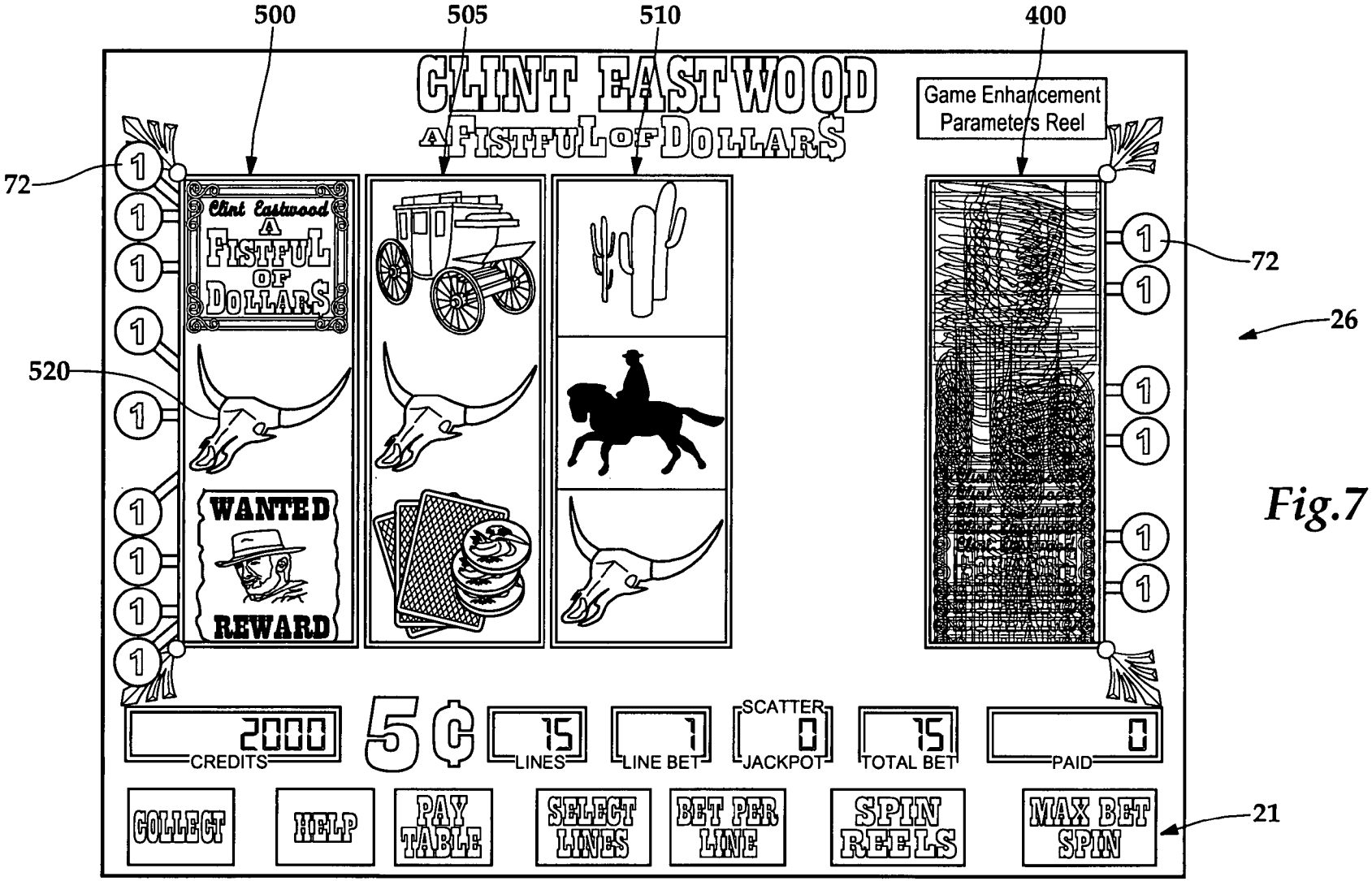
FIG. 7 illustrates a display screen for a slot game having three regular gambling reels and an additional "Can't Lose" reel according to an embodiment of the invention.

FIG. 7 illustrates a display screen 21 for a slot game having three regular gambling reels 500, 505, and 510, and the additional game-enhancement parameters reel 400 according to an embodiment of the invention. In some embodiments, the game-enhancement parameters reel 400 may be spun before, after, or while the main reels 500, 505, and 510 are spinning, at the player's discretion. In other embodiments, the player has no choice as to the when the game-enhancement parameters reel 400 is to be spun.

As shown in FIG. 7, the game-enhancement parameters reel 400 is still spinning when the first three reels 500, 505, and 510 have stopped spinning. In the event that the player had bet only on the single-line payline comprising the three middle symbols, the player would have achieved a winning combination of two "bull skull" symbols on the reels. However, if the third reel 510 had stopped one symbol earlier, the player would have achieved a better winning combination (i.e., three "bull skull" symbols on the active payline).

Figure 8:
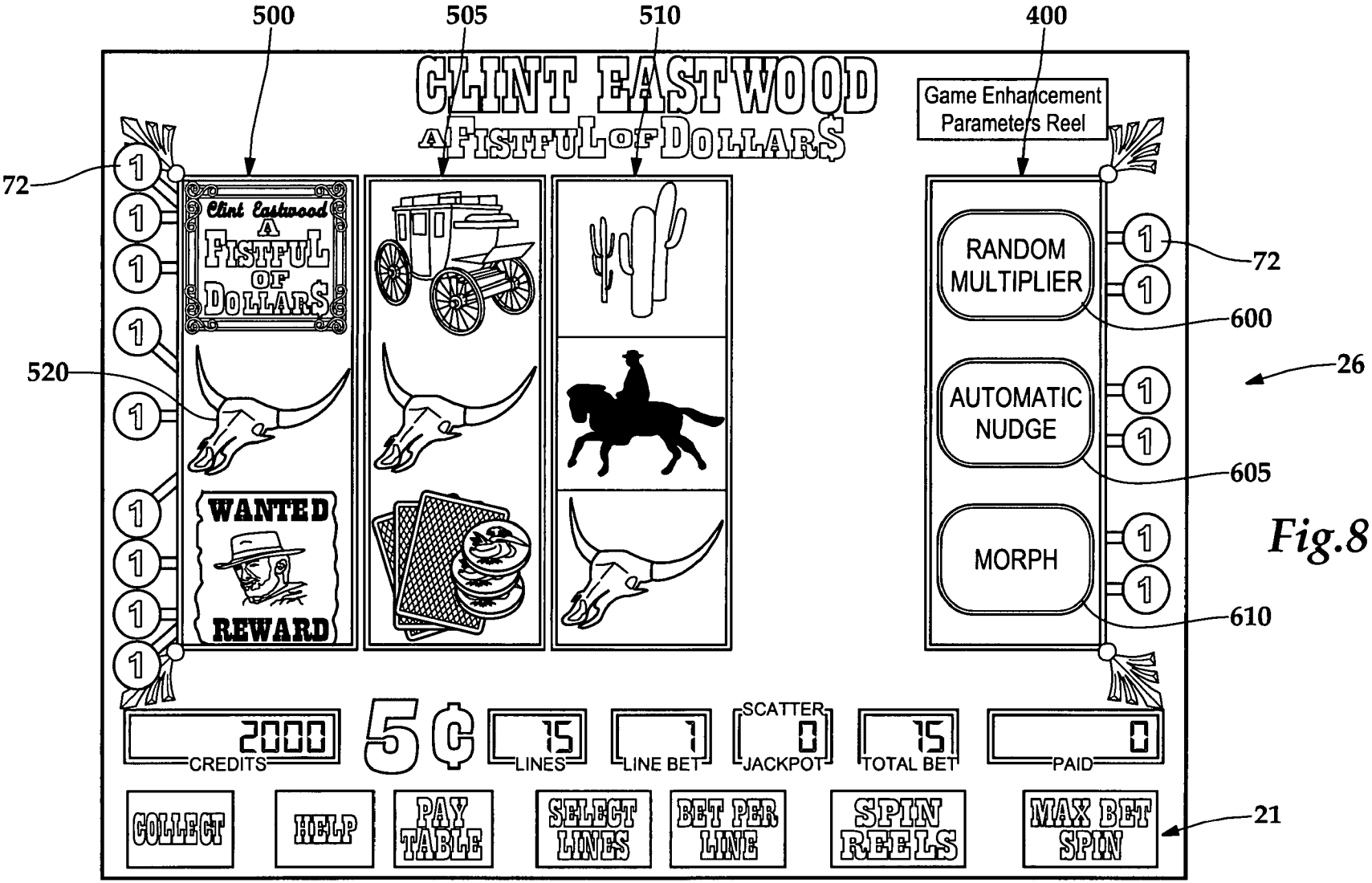
FIG. 8 illustrates the display screen after the "Can't Lose" reel has stopped spinning.

FIG. 8 illustrates the display screen 21 after the game-enhancement parameters reel 400 has stopped spinning. As shown, the middle symbol on the game-enhancement parameters reel 400 is an AUTOMATIC NUDGE game-enhancement parameter 605. Accordingly, the symbols on the third reel 510 will be nudged upward so that the player achieves a winning combination of three "bull skull" symbols 520. If the RANDOM MULTIPLIER game-enhancement parameter 600 or the MORPH game-enhancement parameter 610 symbols had stopped as the middle symbol on the game-enhancement parameters reel 400, then those respective game-enhancement parameters would have been implemented.

While the game-enhancement parameters reel 400 has been shown to indicate the randomly-selected game-enhancement parameter to be applied, other embodiments lack this reel 400. Instead, the game-enhancement parameter may be based on the outcome of a video displayed on the secondary display 27 shown in FIG. 1. For example, the player could be shown a pair of dice rolling on the secondary display 27, and the game-enhancement parameter may be selected based on the results of the dice roll.

Second Embodiment

Accumulation of Game-Enhancement Parameters

In the second embodiment of the invention, game-enhancement parameters (as described above) may be accumulated and then used during a play of the basic game. This is different from the first embodiment listed above where the player accumulates "Can't Lose Spin" bonuses, which are played with a game-enhancement parameter. As such, in this alternative embodiment, the player is not necessarily guaranteed a minimum winning combination when the game-enhancement parameter is implemented, unlike in the first embodiment described above.

For example, if the player has accumulated a RANDOM MULTIPLIER game-enhancement parameter, and then applied this game-enhancement parameter to a basic game that ultimately does not result in a winning combination, then there would be no winning combination to multiply. To avoid this non-winning situation, variations of the second embodiment of the invention may offer to trade an accumulated game-enhancement parameter for a small payout.

In the second embodiment, the game-enhancement parameters may be represented as special symbols on the reels, and when they show up anywhere on the reels (or on an active payline, in some embodiments), they are awarded to the player. The player can then use them at the player's discretion. In some embodiments, the player must decide before the initial spin of the reels whether to use the game-enhancement parameter. For example, in the event that the player has accumulated the "AUTOMATIC NUDGE" game-enhancement parameter, the player can implement this parameter by pressing a button on the display screen 21 or on the panel 22 prior to spinning the reels. However, in the event that the nudging of the reels would not result in a better payout, the player would have used up this game-enhancement parameter even though it did not actually affect the outcome of that particular spin.

Of the game-enhancement parameters discussed above in the "GAME-ENHANCEMENT PARAMETERS" section, at least the following may be implemented in the second embodiment of the invention: "RANDOM MULTIPLIER," "AUTOMATIC NUDGE," "UPGRADE," "DIFFERENT PAY TABLE," "EXTRA WILD," "RIGHT-TO-LEFT," "RE-SPIN," "MORPH," "INCREASED WAGER," "HOLD SYMBOL," "SCATTER," "INCREASED WAGER," and "SYMBOL MOVEMENT." The "SCATTER" and "INCREASED WAGER" game enhancement parameters are described in detail below, and the remainder of these game-enhancement parameters were previously described above.

When a SCATTER game-enhancement parameter is redeemed, a single-line pay into converted to a scatter payout, such that a winning combination of symbols need not be located all on a single active payline. Accordingly, this game-enhancement parameter is often very valuable for the player.

When the INCREASED WAGER game-enhancement parameter is redeemed, a winning combination is treated as though the player had bet the maximum amount, thereby effectively increasing the wagered amount, resulting in a higher payout.

Figure 9:
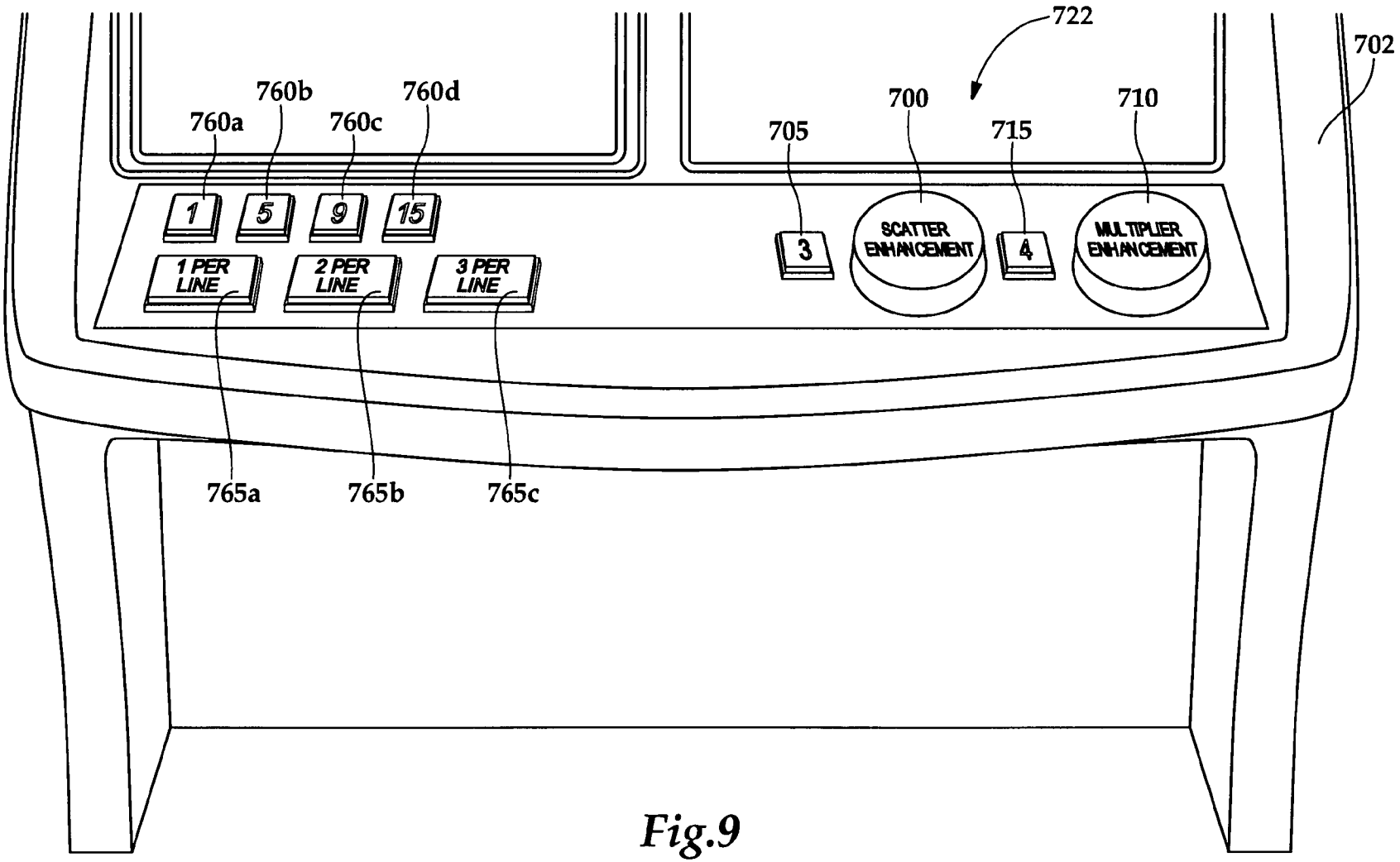
FIG. 9 illustrates another gaming terminal that provides for accumulating a game-enhancement parameter.

FIG. 9 illustrates another gaming terminal 702 that provides for accumulating a game-enhancement parameter. In FIG. 9, a push button panel 722 of the gaming terminal 702 has a plurality of different buttons that serve to accumulate and actuate certain game-enhancement parameters. The first is a SCATTER enhancement button 700, and the second is a RANDOM MULTIPLIER enhancement button 710. A meter 705 is associated with the SCATTER enhancement button 700, and indicates the number of SCATTER game-enhancement parameters that have been accumulated through game play. A second meter 715 is associated with the RANDOM MULTIPLIER enhancement button 710, and indicates the number of RANDOM MULTIPLIER game-enhancement parameters that have been accumulated through game play. To implement either of these game-enhancement parameters, the player depresses the associated button 700 or 710. In some embodiments, only one of the game-enhancement parameters is redeemed at a time; in other embodiments, both are redeemed at the same time. Also, in other variations of this embodiment, buttons and meters for other game-enhancement parameters may be displayed. Alternatively, the player may depress the respective button to redeem a game-enhancement parameter at any time up until one or more of the reels have stopped spinning. The game-enhancement parameter must be redeemed before the reels start spinning in additional variations of this embodiment.

As can be appreciated from the discussion above, the second embodiment has a number of different aspects. One of the aspects of the second embodiment is directed to the gaming terminal for playing a wagering game. A wager-input device receives a wager from a player. A display displays symbols during the wagering game. The symbols indicate a randomly selected outcome selected from a plurality of outcomes. The outcomes include at least one game-enhancement outcome for providing game-enhancement features of the wagering game. At least one game-enhancement indicator indicates an accumulation of the game-enhancement features. A game-enhancement activator allows the player to selectively implement an accumulated game-enhancement feature during a game play of the wagering game. The game-enhancement feature increases the probability of an enhanced payout.

Another aspect to the second embodiment is directed to a method of conducting the wagering game. A wager is received from a player. A game outcome is randomly selected from a plurality of outcomes in response to the wager. The outcomes include at least one game-enhancement outcome for providing a game-enhancement feature of the wagering game. The game-enhancement features are accumulated. The game-enhancement features increases a probability of an enhanced payout. The game outcome is displayed, and an accumulated game-enhancement feature is selectively implemented during a game play of the wagering game.

An additional aspect of the second embodiment is directed to a gaming system for playing the wagering game. The gaming system has at least one display and a controller coupled to the display. The controller is programmed to initiate the wagering game in response to detection of a wager from a player. The wagering game displays symbols indicating a randomly selected outcome selected from a plurality of outcomes. The outcomes include at least one game-enhancement outcome for providing game-enhancement features of the wagering game. The controller is further programmed to indicate an accumulation of the game-enhancement features, and selectively implement an accumulated one of the game-enhancement features during a game play of the wagering game. The game-enhancement feature increases a probability of an enhanced payout.

Third Embodiment

Free Spins with Game-Enhancement Parameters

A third embodiment of the invention awards free spins to the player, each of which is associated with a particular game-enhancement parameter. The third embodiment differs from the first embodiment in that the third embodiment does not provide the "guaranteed win" feature (i.e., when a free spin is redeemed, the player is not guaranteed to receive a winning combination). The third embodiment differs from the second embodiment in that the player accumulates free spins associated with game-enhancement parameters, instead of just accumulating the game-enhancement parameters themselves. Of the game-enhancement parameters discussed above in the "GAME-ENHANCEMENT PARAMETERS" section, at least the following may be implemented in the third embodiment of the invention: "RANDOM MULTIPLIER,"

"AUTOMATIC NUDGE," "UPGRADE," "DIFFERENT PAY TABLE," "EXTRA WILD," "RIGHT-TO-LEFT," "RE-SPIN," "MORPH," "INCREASED WAGER," "HOLD SYMBOL," "SCATTER," "INCREASED WAGER," and "SYMBOL MOVEMENT."

The reels may contain standard symbols and "free spin" symbols. Each of the "free spin" symbols may list an associated game-enhancement parameter. For example, a "free spin" symbol may read "RANDOM MULTIPLIER free spin" or "UPGRADE free spin." Such "free spin" symbols may be located at various locations on the reels for each of the game-enhancement parameters available in the third embodiment.

Alternatively, the player may accumulate generic "free spin" symbols during game play and the game-enhancement parameter associated with each of the "free spin" symbols is subsequently selected based on a spin of an additional game-enhancement parameters reel similar to the one described above with respect to the first embodiment, as illustrated in FIG. 6. For example, if the basic slot game has three reels, a fourth reel may be utilized on which various potential game-enhancement parameters are represented. Similarly, in embodiments having five reels in the basic slot game, a sixth reel having the various game-enhancement parameters may be utilized when one of the "free spin" symbols is redeemed. Once the game-enhancement parameters reel stops spinning, the game-enhancement parameter on the payline may be applied to the combination shown on the other reels. The selection of the game-enhancement parameters is therefore preformed in a manner similar to that of the first embodiment described above with respect to FIGS. 6-8.

These "free spin" symbols may be accumulated during game play and then redeemed at a time of the player's choosing. The player may be presented with different buttons allowing the player to select one of the free spins associated with a known game-enhancement parameter.

Figure 10:
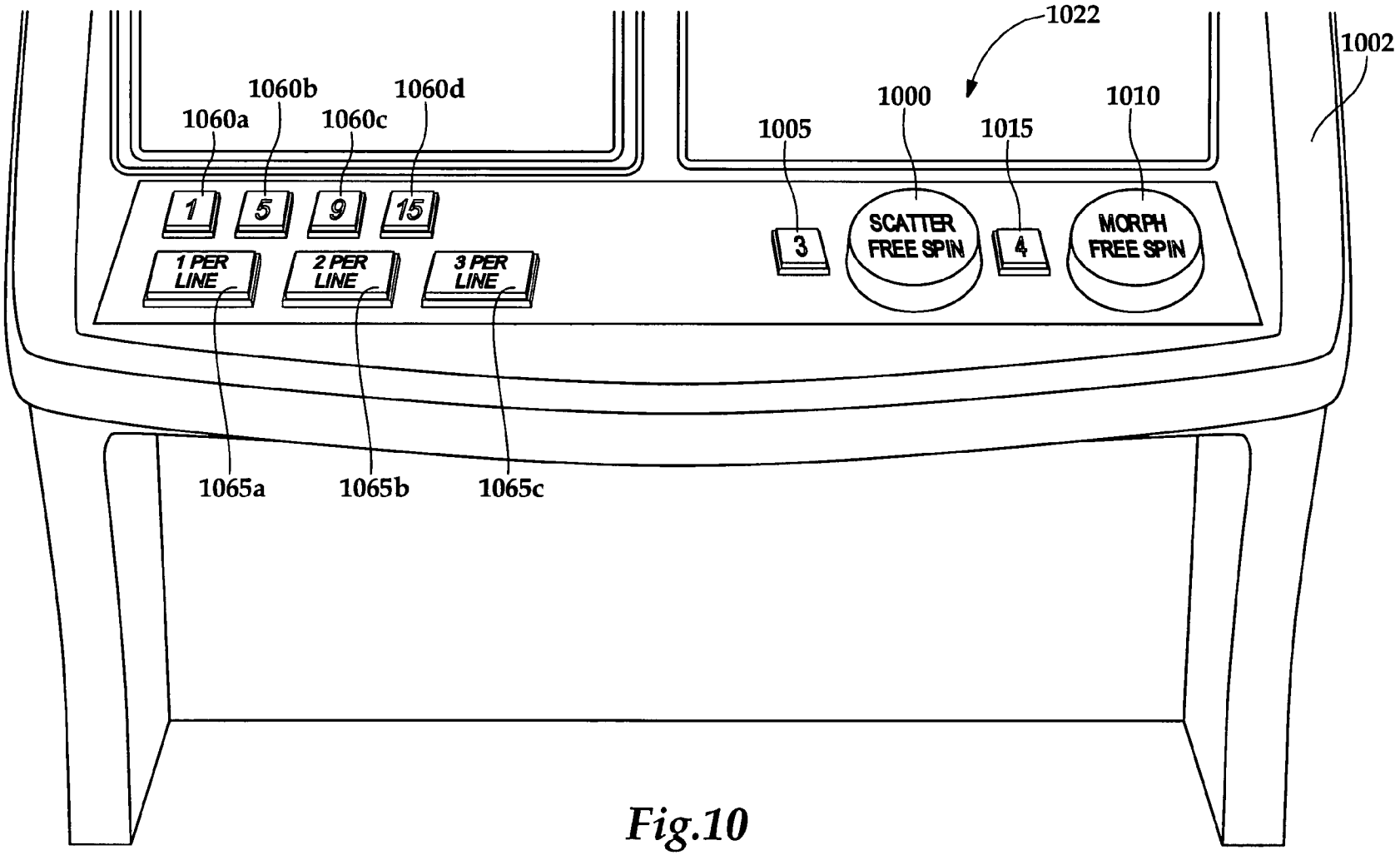
FIG. 10 illustrates another gaming terminal that provides for accumulating "free spin" symbols having associated game-enhancement parameters according to an embodiment of the invention.

FIG. 10 illustrates another gaming terminal 1002 that provides for accumulating "free spin" symbols having associated game-enhancement parameters. In FIG. 10, a push button panel 1022 of the gaming terminal 1002 has a plurality of different buttons that serve to accumulate and actuate the free spins. The first is "SCATTER free spin" button 1000, and the second is a "MORPH free spin" button 1010. A meter 1005 is associated with the "SCATTER free spin" button 1000, and indicates the number of "SCATTER free spins" that have been accumulated through game play. A second meter 1015 is associated with the "MORPH free spin" button 1010, and indicates the number of "MORPH free spins" that have been accumulated through game play. To redeem either of these free spins, the player depresses the associated button 1000 or 1010. In other embodiments, buttons and meters for "free spins" associated with other game-enhancement parameters may also be displayed.

In additional embodiments, the "free spin" symbols do not indicate their associated game-enhancement parameters, and when these "free spins" are redeemed, the player does not know of the identity of the associated game-enhancement parameters until after the "free spins" have already been redeemed.

Various modifications to the three embodiments described above may be made. For example, the player may be able to trade a win in the basic game for a "Can't Lose Spin" bonus in a modification to the first embodiment discussed above with respect to FIGS. 3-9. In other words, the player may forego the winning payouts in the basic game and instead select a "Can't Lose Spin" bonus to use at a later time. This may be advantageous in the event that the player gets the lowest possible payout during the basic game, since the player would be guaranteed a payout in the "Can't Lose Spin" bonus that is at least equivalent to this payout and may be substantially higher. In some embodiments, only certain minimum winning combinations may be traded for "Can't Lose Spin" bonuses—i.e., the player would not be able to trade in the lowest-paying winning combination for a "Can't Lose Spin" bonus. Alternatively, the player may be able to trade a win in the basic game for a game-enhancement parameter in a modification to the second embodiment discussed above with respect to FIG. 9, or for one of the free spins in a modification of the third embodiment.

In other modifications to the first embodiment, special bonus events or progressive events are only available when the player uses a "Can't Lose Spin" bonus. In other words, during the basic game, the player has no chance of achieving a win that would allow participation in the bonus events or the progressive events. The player must accumulate a "Can't Lose Spin" bonus, and as one of the winning "Can't Lose Spin" bonus combinations, the player may win the chance to play the bonus events or the progressive events.

An additional alternative to accumulating the "Can't Lose Spin" bonuses of the first embodiment is to provide the player a "Can't Lose Spin" bonus or a portion thereof based on the amount of wagers that the player has made at the gaming terminal. Thus, the player may accumulate ⅕ of a "Can't Lose Spin" bonus for a 1-credit play, but may accumulate a full "Can't Lose Spin" bonus if the player has played all of the paylines at the maximum wager amount.

While the present invention has been described with reference to three or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A gaming terminal for playing a wagering game, comprising:

a wager-input device for receiving a wager from a player;

a display displaying symbols indicating a randomly selected outcome selected from a plurality of outcomes in response to receiving the wager, the plurality of outcomes including at least one special-event outcome that awards additional game play at the gaming terminal at a time of the player's choosing and selectable by the player, wherein the time includes a time after the player has placed a wager via the wager-input device on a subsequent wagering game on the gaming terminal subsequent to the displaying the symbols indicating the randomly selected outcome, the additional game play providing a guaranteed winning outcome, the wager-input device receiving from the player, after the randomly selected outcome has been displayed, a second wager on a second wagering game displayed on the display, the second wager being received after the first wager is received and before the additional game play is initiated; and a special-event input device causing a controller to initiate the additional game play in response to the player activating the special-event input device, wherein the additional game play is implemented with a game-enhancement parameter such that the guaranteed winning outcome has an enhanced payout.

2. The gaming terminal of claim 1, wherein the display indicates an accumulated amount of the at least one special-event outcome.

3. The gaming terminal of claim 1, wherein the wagering game is selected from the group consisting of: mechanical slots, video slots, video poker, video blackjack, video keno and video bingo.

4. The gaming terminal of claim 1, wherein the game-enhancement parameter is selected from the group consisting of: (a) a random multiplier; (b) an automatic nudge feature; and (c) an upgrade win feature causing a winning symbol combination to move up winning symbol combinations on a pay table.

5. The gaming terminal of claim 1, wherein the game-enhancement parameter is selected from the group consisting of: (a) an addition of a wild symbol during the additional game play; (b) a conversion from a single-line payline to a scatter award during the additional game play; and (c) a re-spin of a moveable reel.

6. The gaming terminal of claim 1, wherein the game-enhancement parameter is selected from the group consisting of: (a) a morphing of a symbol on a moveable reels into another symbol that is more beneficial; (b) allowing a player to hold a symbol in a certain location so that a winning combination in the additional game play has to take into account the held symbol; and (c) a movement of symbols on symbol-bearing moveable reels from an initial location to a second location along a payline to form a modified symbol combination if the modified symbol combination would result in a better outcome than an initial symbol combination on the symbol-bearing moveable reels.

7. The gaming terminal of claim 1, wherein in response to the additional game play being initiated, the game-enhancement parameter is selected from a symbol-bearing moveable reel, the symbols on the symbol-bearing moveable reel being representative of a plurality of game-enhancement parameters.

8. The gaming terminal of claim 1, wherein the game-enhancement parameter is randomly assigned to the player from a plurality of game-enhancement parameters.

9. The gaming terminal of claim 1, wherein a winning combination during standard game play is exchangeable for the additional game play.

10. The gaming terminal of claim 1, wherein the game-enhancement parameter operates on the symbols indicating the randomly selected outcome.

11. A method of conducting a wagering game, the method comprising:

receiving a first wager from a player;

randomly selecting a game outcome from a plurality of outcomes in response to the first wager, the plurality of outcomes including at least one special-event outcome that awards additional game play at a time of the player's choosing and selectable by the player, wherein the time includes a time after the player has placed a wager on a subsequent wagering game on the gaming terminal subsequent to the displaying the symbols indicating the randomly selected outcome, the additional game play providing a guaranteed winning outcome;

displaying the game outcome on a display;

after displaying the game outcome and before the additional game play is initiated, receiving a second wager from the player on a second wagering game and displaying a randomly selected game outcome of the second wagering game on the display in response to the second wager; and in response to the player activating a special-event input device, initiating the additional game play, wherein the additional game play is implemented with a game-enhancement parameter such that the guaranteed winning outcome has an enhanced payout.

12. The method of claim 11, wherein in response to the additional game play being initiated, the game-enhancement parameter is selected from a symbol-bearing moveable reel, the symbols on the symbol-bearing moveable reel being representative of a plurality of game-enhancement parameters.

13. The method of claim 11, further including randomly assigning the game-enhancement parameter to the player from a plurality of game-enhancement parameters.

14. A gaming system for playing a wagering game, comprising:

at least one display; and a controller coupled to the display, the controller including a memory that stores instructions that are executed by the controller to cause the controller to:

initiate the wagering game in response to detection of a first wager from a player at a gaming terminal, wherein the wagering game displays symbols indicating a randomly selected outcome selected from a plurality of outcomes, the plurality of outcomes including at least one special-event outcome that awards additional game play at a time of the player's choosing and selectable by the player, wherein the time includes a time after the player has placed a wager on a subsequent wagering game on the gaming terminal subsequent to the displaying the symbols indicating the randomly selected outcome, the additional game play providing a guaranteed winning outcome; and initiate a second wagering game in response to detection of a second wager from the player at the gaming terminal after detecting the first wager from the player at the gaming terminal and before the additional game play is initiated; and initiate the additional game play in response to a special-event input by the player, the additional game play being implemented with a game-enhancement parameter such that the guaranteed winning outcome has an enhanced payout.

15. The gaming system of claim 14, wherein the display and the controller are both located within a gaming terminal.

16. The gaming system of claim 14, wherein the display is located within a gaming terminal and the controller is located outside of the gaming terminal.

17. The gaming system of claim 14, wherein the display indicates an accumulated amount of the at least one special-event outcome.

18. The gaming system of claim 14, wherein the wagering game is selected from the group consisting of: mechanical slots, video slots, video poker, video blackjack, video keno and video bingo.

19. The gaming system of claim 14, wherein the game-enhancement parameter is randomly assigned to the player from a plurality of game-enhancement parameters.

20. The gaming system of claim 14, wherein in response to the additional game play being initiated, the game-enhancement parameter is selected from a symbol-bearing moveable reel, the symbols on the symbol-bearing moveable reel being representative of a plurality of game-enhancement parameters.

* * * * *